US009004790B2

(12) United States Patent
Kishi et al.

(10) Patent No.: US 9,004,790 B2
(45) Date of Patent: Apr. 14, 2015

(54) CUTTER UNIT TO BE INCORPORATED INTO A PRINTER, HAVING A CONTROL ELEMENT

(75) Inventors: Kazuo Kishi, Tokorozawa (JP); Toshihiko Nakai, Tokorozawa (JP); Kazuhito Amano, Fujiyoshida (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 177 days.

(21) Appl. No.: 13/403,147

(22) Filed: Feb. 23, 2012

(65) Prior Publication Data

US 2012/0219344 A1 Aug. 30, 2012

(30) Foreign Application Priority Data

Feb. 24, 2011 (JP) ..... 2011-037888
May 19, 2011 (JP) ..... 2011-112002

(51) Int. Cl.

| | |
|---|---|
| ***B26D 1/08*** | (2006.01) |
| ***B41J 11/70*** | (2006.01) |
| ***B41J 11/66*** | (2006.01) |
| ***B26D 5/00*** | (2006.01) |
| ***B26D 5/08*** | (2006.01) |
| *B26D 1/00* | (2006.01) |

(52) U.S. Cl.

CPC ..... *B41J 11/666* (2013.01); *B26D 1/085* (2013.01); *B26D 5/00* (2013.01); *B26D 5/086* (2013.01); *B41J 11/663* (2013.01); *B26D 2001/006* (2013.01)

(58) Field of Classification Search

CPC .. B26D 1/085; B26D 5/086; B26D 2001/006; B41J 11/666; B41J 11/70; B41J 11/706; B41J 11/703

USPC ..... 400/621, 593; 83/679, 694, 695; 318/560, 567

See application file for complete search history.

(56) References Cited

U.S. PATENT DOCUMENTS 5,971,639 A * 10/1999 Park ..... 400/621
2003/0103793 A1* 6/2003 Murakoshi et al. ..... 400/621

(Continued)

FOREIGN PATENT DOCUMENTS

JP 5-154791 6/1993
JP 2001-158140 6/2001
JP 3332226 * 7/2002 ..... H02K 21/14

(Continued)

OTHER PUBLICATIONS

"Technosoft Drives and Motors Provide More Intelligence to CANopen" published in 2003.*
Technosoft "Application Note" published on Dec. 23, 2005.*

*Primary Examiner* — Blake A Tankersley
(74) *Attorney, Agent, or Firm* — Wenderoth, Lind & Ponack, L.L.P.

(57) ABSTRACT

A cutter unit is incorporated in a printer to cut a paper in accordance with an instruction from a controller of the printer. The cutter unit includes a cutter blade, a position sensor for detecting that the cutter blade is or is not in a reference position, a motor for driving the cutter blade, a drive circuit for the motor, and a cutter control element for controlling the drive circuit on the basis of a result of the detection of the position sensor to operate the cutter blade in accordance with the instruction from the controller.

12 Claims, 4 Drawing Sheets

(56) References Cited

U.S. PATENT DOCUMENTS

| | | | | |
|---|---|---|---|---|
| 2004/0184863 | A1* | 9/2004 | Mori et al. | 400/621 |
| 2005/0212475 | A1* | 9/2005 | Kakutani et al. | 318/567 |

FOREIGN PATENT DOCUMENTS

| | | | | |
|---|---|---|---|---|
| JP | 2002-346987 | | 12/2002 | |
| JP | 2004034328 | * | 2/2004 | B41J 11/70 |

* cited by examiner

CUTTER UNIT TO BE INCORPORATED INTO A PRINTER, HAVING A CONTROL ELEMENT

CROSS REFERENCE TO RELATED APPLICATION

The present application is based on and claims priority from Japanese Patent Application No. 2011-37888, filed on Feb. 24, 2011 and No. 2011-112002, filed on May 19, 2011, the disclosure of which is hereby incorporated by reference in its entirety.

BACKGROUND OF THE INVENTION

1. Field of the Invention

The present invention relates to a cutter unit, particularly to an improvement in the control over the operation of a cutter unit incorporated in a printer.

2. Description of the Prior Art

In prior art a guillotine type or pizza cutter type paper cutter is incorporated in a POS (Point of Sale System) printer, and it is configured to detect a cutter blade in a reference position by a position detector such as a switch or a photosensor and drive it by a drive source such as a DC motor or a stepping motor. Such a cutter blade, a position detector and a drive source are accommodated in a case to constitute a cutter unit. The cutter unit can be incorporated in a printer such as POS printer, cash register, various types of ticketing machine and controlled by the printer.

Japanese Patent Application Publication No. 2001-158140, No. H5-154791 and No. 2002-346987 disclose such a printer which includes the cutter unit, a drive circuit for a motor as a drive source, a motor control circuit, and a detection circuit to process detected results of a position detector to control the cutter unit.

In this printer, the cutter unit is required to perform a simple operation of fully cutting or partially cutting a printed paper only. However, to realize the cutting operation, the printer has to be designed with the following basic cutter operations taken into account:

1. Initial operation to set the cutter blade at the reference position
2. Two types of cutting operation as partial cut or full cut-off
3. Error handling when anomaly occurs To design these basic operations, the printer needs to be designed precisely in conformity with the specification of the cutter unit, which is very troublesome and time consuming. There may be a case where some content of the specification is overlooked.

This imposes an extraneous burden on the designing of the printer. In addition, the operational quality of the cutter unit is degraded if the precise designing conformity is not realized.

SUMMARY OF THE INVENTION

An object of the present invention is to provide a cutter unit which is incorporated in a printer and can properly, reliably operate while reducing a burden on the designing of the control of the printer.

According to one aspect of the present invention, a cutter unit incorporated in a printer to cut a paper in accordance with an instruction from a controller of the printer. The cutter unit includes a cutter blade, a position sensor for detecting that the cutter blade is or is not in a reference position, a motor for driving the cutter blade, a drive circuit for the motor, and a cutter control element for controlling the drive circuit on the basis of a result of the detection of the position sensor to operate the cutter blade in accordance with the instruction from the controller. The cutter control element is configured to control the drive circuit to set the cutter blade at the reference position upon receiving a partial cut or full cut instruction from the controller, drive the motor at an amount so that the paper is partially cut by the cutter blade with a part of the paper remaining uncut, when receiving the partial cut instruction, drive the motor at an amount so that the paper is completely cut by the cutter blade, when receiving the full cut instruction, and drive the motor at an amount so that the cutter blade is returned to the reference position, after the cutting operation is completed.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENT

Hereinafter, embodiments of a cutter unit according to the present invention will be described in detail with reference to the accompanying drawings. Wherever possible, the same reference numbers will be used throughout the drawings to refer to the same or like parts.

First Embodiment

Figure 1:
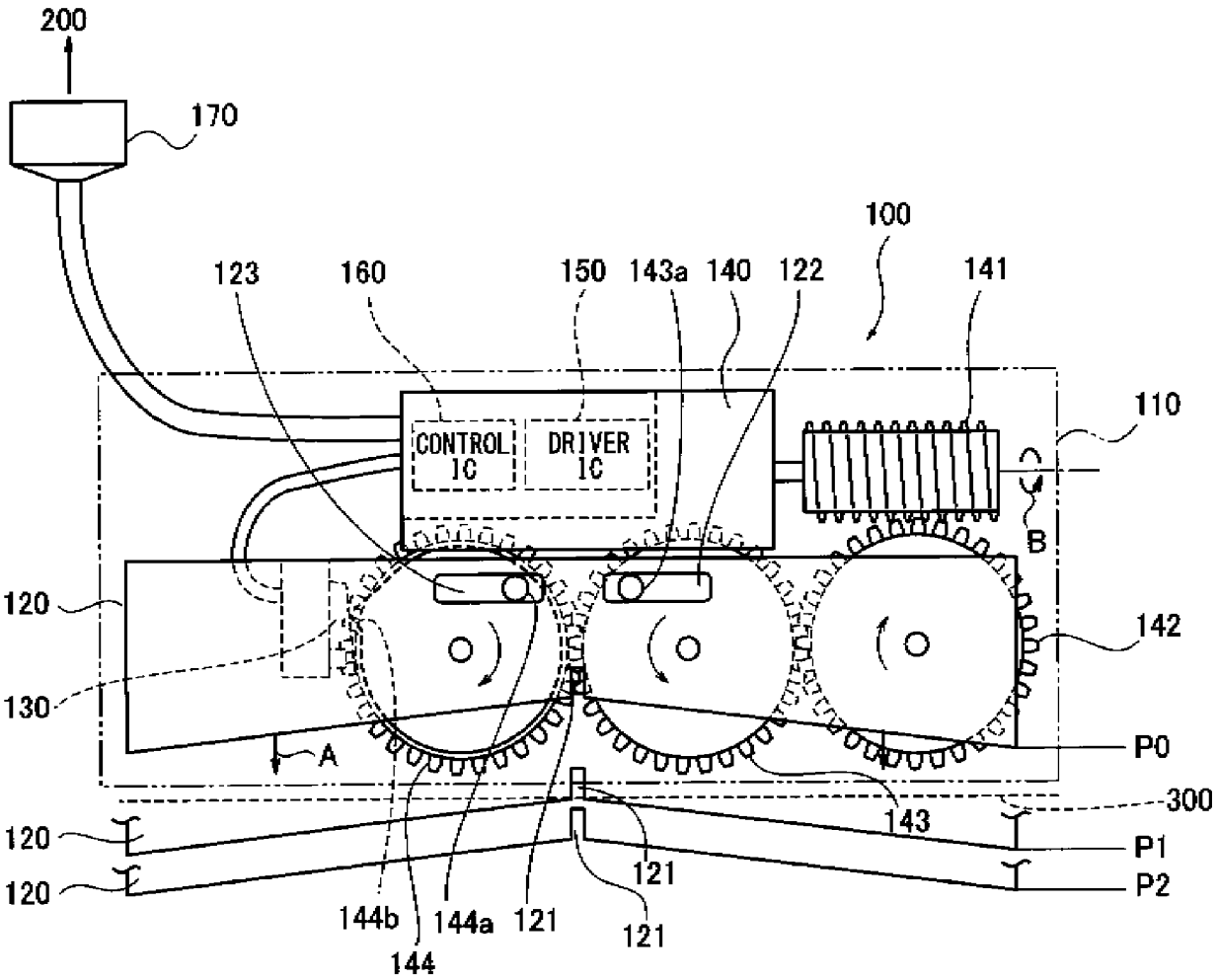
FIG. 1 shows an example of a cutter unit according to a first embodiment of the present invention.

FIG. 1 shows a cutter unit 100 according to a first embodiment of the present invention. The cutter unit 100 is not intended for use by itself but to be incorporated in a printer 200 such as POS printer, cash register, or various types of ticketing machines to cut a paper 300 on which text or graphics is printed by the printer 200.

The cutter unit 100 includes, in a case 110, a cutter blade 120 to move down in the direction of arrow A to cut the paper 300 indicated by a broken line, a switch 130 as a position sensor to detect that the cutter blade 120 is in a predetermined pre-cutting reference position P0, and a motor 140 for the cutter blade 120.

The motor 140 accommodates a driver IC 150 as a drive circuit for the motor 140 and a control IC 160 as a cutter control element. The control IC 160 is configured to control the driver IC 150 on the basis of a detected result of the switch 130 to operate the cutter blade 120 in accordance with an instruction from the printer 200.

The cutter blade 120 is formed to be inclined to the center from both ends in the width direction of the paper 300 so that the height thereof (vertical direction in the drawing) is higher at both ends than at the center. It also includes a notch 121 at the center.

Further, the cutter blade 120 includes rectangular holes 122, 123 extending along the width at symmetric positions relative to the notch 121. A protrusion 143*a* of a later-described second worm wheel 143 is inserted into the hole 122, while a protrusion 144*a* of a third worm wheel 144 is inserted into the other hole 123.

The motor 140 is a stepping motor driven by the driver IC 150. Alternatively, it can be a DC motor or the like.

A worm 141 is joined with the rotary shaft of the motor 140. A first worm wheel 142 engaged with the worm 141, the second worm wheel 143 engaged with the first worm wheel 142, and a third worm wheel 144 engaged with the second worm wheel 143 are rotatably supported in the case 110. The worm wheels are depicted as spur wheels in the drawing for simplicity.

The second worm wheel 143 and third worm wheel 144 are formed to have the same diameter and the same number of teeth and rotate in opposite directions. They include columnar protrusions 143*a*, 144*a* at predetermined phase positions in their rotary directions, respectively.

The protrusions 143*a*, 144*a* are formed at the same phase position from the position at which the second and third worm wheels 143, 144 are engaged with each other.

Along with the rotation of the second and third worm wheels 143, 144, the protrusions 143*a*, 144*a* are moved in synchronization and symmetrically relative to the engaging position of the worm wheels 143, 144.

Then, the protrusions 143*a*, 144*a* are inserted into the holes 122, 123 of the cutter blade 120 respectively and moved horizontally and vertically to elevate or lower the cutter blade 120.

Due to the symmetrical, synchronized movement of the protrusions 143*a*, 144*a*, the cutter blade 120 vertically falls or rises straight with no inclination relative to the blade width.

A position sensor includes a claw 144*b* (position indicating element) and a switch 130. The claw 144*b* is formed in the third worm wheel 144 to mechanically press contact the switch 130 while the cutter blade 120 is located at the reference position P0, and the claw 144*b* is separated from the switch 130 not to press it while the cutter blade 120 is moved below the reference position P0.

The switch 130 is provided at a certain position of the case 110. The position sensor including the switch 130 generates a position signal. In particular, upon being mechanically pressed by the position indicating element, it outputs an ON signal, and while not being pressed, it outputs an OFF signal to the control IC 160.

Thus, the ON signal is output while the cutter blade is at the reference position P0, and the OFF signal is output while it is not at the reference position P0. The control IC 160 can therefore determine whether or not the cutter blade 120 stops at the reference position P0 in accordance with the ON/OFF signals from the switch 130.

Note that alternatively, the switch 130 can be configured to output an electric signal only when pressed by the claw 144*b*. With such a switch 130, presence or absence of the cutter blade 120 at the reference position P0 can be determined from the output or non-output of the electric signal.

Moreover, the switch 130 should not be limited to the one for mechanically detecting pressure of the claw 144*b*, as described in the present embodiment. Alternatively, the switch 130 can be a photo interrupter (optical switch) to optically detect light blocking by the claw 144*b*.

Two stop positions, first and second positions P1, P2 are set for the cutter blade 120. At the second position P2, the cutter blade 120 including the notch 121 comes below the paper 300, so that the paper 300 is completely cut by moving down the cutter blade 120 to the second position P2.

Meanwhile, the first position P1 is set to be higher than the second position P2. At the first position P1, the cutter blade 120 excluding the notch 121 comes below the paper 300. Therefore, by moving down the cutter blade 120 to the first position P1, the paper 300 is partially cut with a portion corresponding to the notch 121 remaining uncut.

The control IC 160 is connected with the printer 200 via an electric connector 170. When completing printing onto the paper 300, the printer 200 outputs an electric signal indicating a full cut or partial cut instruction to the control IC 160 via the electric connector 170.

Upon receiving the electric signal from the printer 200, the control IC 160 controls the driver IC 150 on the basis of the output signal of the switch 130 (presence or absence of the cutter blade 120 at the reference position P0) to drive the cutter blade 120 to cut the paper fully or partially.

Figure 2:
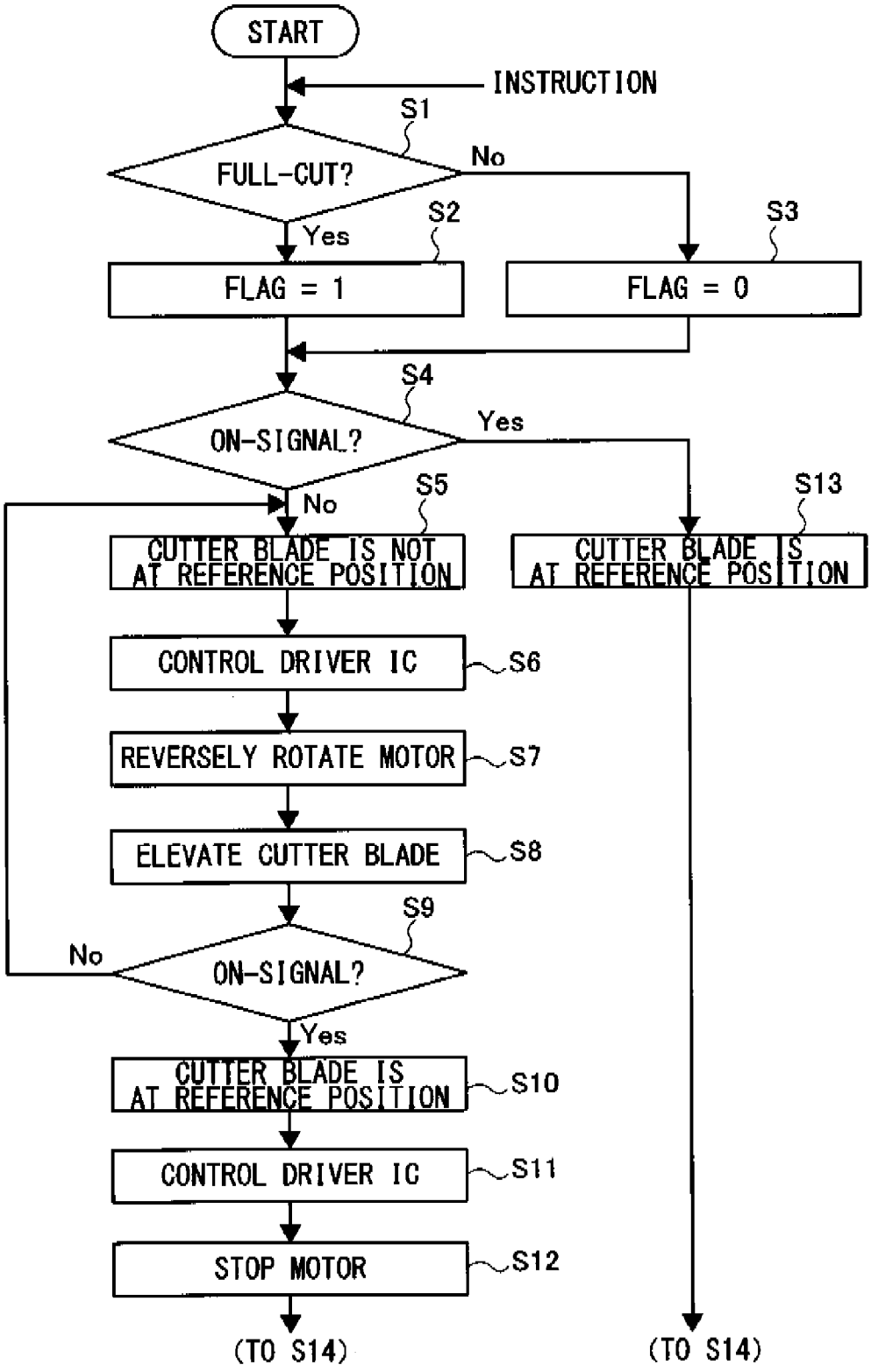
FIG. 2 is a flowchart for the control process by a control IC.
Figure 3:
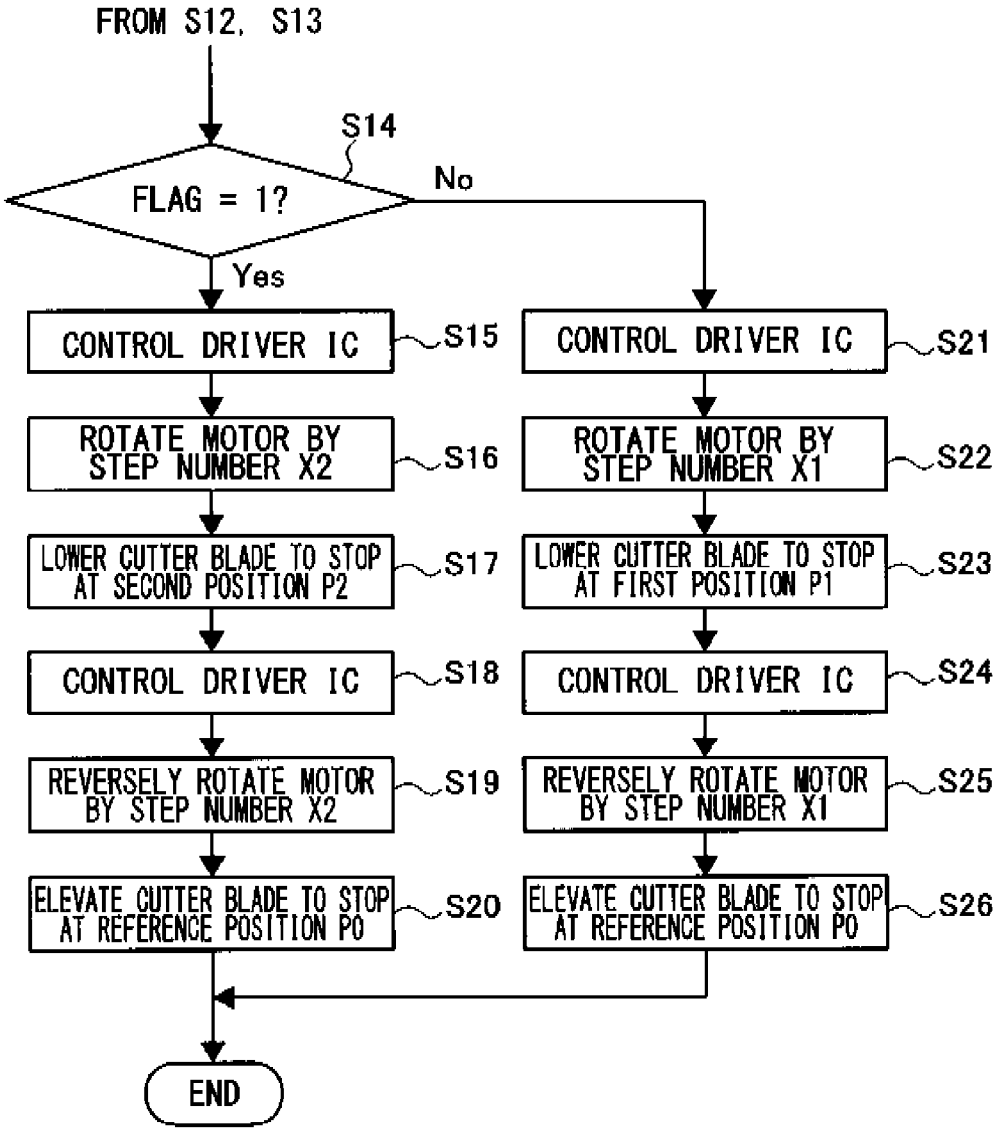
FIG. 3 is a flowchart following FIG. 2.

Specifically, referring to the flowcharts in FIGS. 2, 3, the control IC 160 sets a flag to 0 upon receipt of a partial cut instruction in steps S1 to S3 and sets a flag to 1 upon receipt of a full-cut instruction in steps S1 to S2.

In step S4 the control IC 160 determines whether or not the cutter blade 120 is at the reference position P0 on the basis of the electric signal from the switch 130. Determining that the cutter blade 120 is not at the reference position P0, it controls the initial operation of the driver IC 150 to set the cutter blade 120 in the reference position P0 in steps S5 to S12.

That is, in step S4 the control IC 160 determines whether or not it receives the ON-signal from the switch 130. When receiving the ON-signal, it determines that the cutter blade 120 is at the reference position P0 in step S13.

Meanwhile, upon receiving the OFF-signal or not receiving the ON-signal, the control IC 160 determines that the cutter blade 120 is not at the reference position P0 in step S5, and controls the driver IC 150 to elevate the cutter blade 120 in step S6.

The driver IC 150 drives the motor 140 in reverse direction to the arrow B in FIG. 1 under the control of the control IC 160 in step S7. The rotation of the motor 140 is transmitted to the worm 141 and the first to third worm wheels 142 to 144 in order, and the protrusions 143*a*, 144*a* are moved along with the rotation of the second and third worm wheels 143, 144 to move the holes 122, 123 upward and elevate the cutter blade 120 in step S8.

The cutter blade 120 continues elevating until the claw 144*b* of the third worm wheel 144 presses the switch 130 in step S9. Upon receipt of the ON-signal from the switch 130, the control IC 160 determines that the cutter blade 120 is at the reference position P0 in step S10, drives the driver IC 150 in step S11, and stops the motor 140 in step S12.

This processing in steps S4, S5 to S12 and S4 to S13 is the initial operation controlled by the control IC 160.

After completion of the control of the initial operation, in steps S14 to S15 when receiving the full-cut instruction from the printer 200 or when the flag is set to 1 in step S2, the control IC 160 controls the driver IC 150 to lower the cutter blade 120 from the reference position P0 and stop it at the second position P2.

Under the control of the control IC 160, the driver IC 150 provides a necessary number of steps X2 to the motor 140 to rotate at a number of times for lowering the cutter blade 120 from the reference position P0 to the second position P2. Then, the motor 140 rotates at the number of times along the arrow B and stops rotating in step S16.

The rotation of the motor 140 is transmitted to the worm 141 and the first to third worm wheels 142 to 144 in order, and the protrusions 143*a*, 144*a* of the second and third worm wheels 143, 144 press down the holes 122, 123 of the cutter blade 120 to lower the cutter blade 120 to stop at the second position P2 in step S17. Thereby, the paper 300 is fully cut.

Then, due to the rotation of the motor 140 along the arrow B, the claw 144*b* of the third worm wheel 144 is separated from the switch 130 and the switch 130 outputs the OFF-signal to the control IC 160 or stops outputting the ON-signal.

The control IC 160 controls the driver IC 150 to elevate the cutter blade 120 to the reference position P0 in step S18.

Under the control of the control IC 160, the driver IC 150 provides a necessary number of steps X2 to the motor 140 to rotate at a number of times for moving up the cutter blade 120 from the second position P2 to the reference position P0. Then, the motor 140 rotates at the number of times in the reverse direction to the arrow B and stops rotating in step S19. The cutter blade 120 is elevated to stop at the reference position P0 in step S20. Thus, the operation of the cutter unit 100 by the full-cut instruction from the printer 200 is completed.

Meanwhile, upon receipt of the partial cut instruction from the printer 200 or when the flag is set to 0 in step S2, the control IC 160 controls the driver IC 150 to lower the cutter blade 120 from the reference position P0 to stop at the first position P1 in steps S14 to S21.

Under the control of the control IC 160, the driver IC 150 provides a necessary number of steps X2 to the motor 140 to rotate at a number of times for lowering the cutter blade 120 from the reference position P0 to the first position P1. Then, the motor 140 rotates at the number of times along the arrow B and stops operating in step S22.

The rotation of the motor 140 is transmitted to the worm 141 and the first to third worm wheels 142 to 144 in order, and the protrusions 143*a*, 144*a* of the second and third worm wheels 143, 144 press down the holes 122, 123 of the cutter blade 120 to lower the cutter blade 120 to stop at the first position P1 in step S23. Thereby, the paper 300 is partially cut with a portion corresponding to the notch 121 remaining uncut.

Due to the rotation of the motor 140 along the arrow B, the claw 144*b* of the third worm wheel 144 is separated from the switch 130 and the switch 130 outputs the OFF-signal to the control IC 160 or stops outputting the ON-signal.

Then, the control IC 160 controls the driver IC 150 to elevate the cutter blade 120 to the reference position P0 in step S24.

Controlled by the control IC 160, the driver IC 150 provides a necessary number of steps X1 to the motor 140 to rotate at a number of times for lowering the cutter blade 120 from the first position P1 to the reference position P0. Then, the motor 140 rotates at the number of times reversely to the arrow B and stops operating in step S25. The cutter blade 120 is elevated to stop at the reference position P0 in step S26. Thus, the operation of the cutter unit 100 by the partial-cut instruction from the printer 200 is completed.

As described above, upon receiving a full-cut or partial cut instruction from the printer 200 incorporating the cutter unit 100 according to the present embodiment and a detected result of the switch 130 that the cutter blade 120 is or is not at the reference position P0, the control IC 160 controls the driver IC 150 to drive the motor 140 so that the cutter blade 120 operates in accordance with the instruction from the printer 200. Because of this, the printer 200 has only to provide the full-cut or partial cut instruction to the cutter unit 100. In addition, it is made unnecessary to design the printer 200 with a combination of processes needed to realize the operation of the motor 140 and else, for example, the processes in FIGS. 2, 3 taken into account, which can reduce a burden on the designing and assembling of the printer 200. Moreover, the cutter unit 100 can be designed and assembled optimally in conformity with its own specification and it can operate properly and reliably.

Further, the control IC 160 can control the driver IC 150 to set the cutter blade 120 at the reference position P0 by simply receiving a partial cut or full-cut instruction from the printer 200. When receiving the partial cut instruction, it controls the driver IC 150 to control the drive amount (step number X1) of the motor 140 so that the cutter blade 120 partially cuts the paper 300. When receiving the full-cut instruction, it controls the driver IC 150 to control the drive amount (step number X2) of the motor 140 so that the cutter blade 120 fully cuts the paper 300. After cutting the paper 300, the driver IC 150 controls the drive amount of the motor 140 to return the cutter blade 120 to the reference position P0. Thus, with such a cutter unit 100, it eliminates the necessity for the operator to fully know of the mechanism and features of the cutter unit 100 about motor rotation control, prevention of malfunction due to switch chattering or the like. By only receiving the signal indicating the cutting instruction from the printer 200 via the electric connector 170, the cutter unit 100 can control the cutting operations as the initial operation to set the cutter blade 120 at the reference position P0 and the full-cut and partial cut operations. Also, the cutter unit 100 can be easily used in the printer 200.

In addition to the initial operation and the full-cut and partial cut operations, the control IC 160 can be configured to control error processing including enforcedly stopping the motor 140 and enforcedly returning the cutter blade 120 to the reference position P0, when the cutter unit 100 is in unstable or anomalous operation.

Such a control IC 160 can perform the error processing by only receiving an instruction from the printer 200, which eliminates the necessity for the printer 200 to incorporate or be designed with a complicated error process control.

Further, a micro computer, an FPGA (Field Programmable Gate Array; settable by a user or a designer after manufactured), a dedicated IC chip, or an ASIC (Application Specific Integrated Circuit) can be used for the control IC 160.

Furthermore, according to the cutter unit 100 in the present embodiment, the driver IC 150 and control IC 160 are accommodated in the sealed motor 140 so that they are prevented from accumulated paper powders which occur in cutting the paper 300 as well as they become unsusceptible to disturbance due to noise such as static electricity. Accordingly, the cutter unit 100 can reliably and stably operate.

Further, the internal structure of the cutter unit 100 can be simplified since the arrangement of the driver IC 150 and control IC 160 does not need to be considered, which can improve the degree of freedom at which the cutter unit is designed.

Second Embodiment

Figure 4:
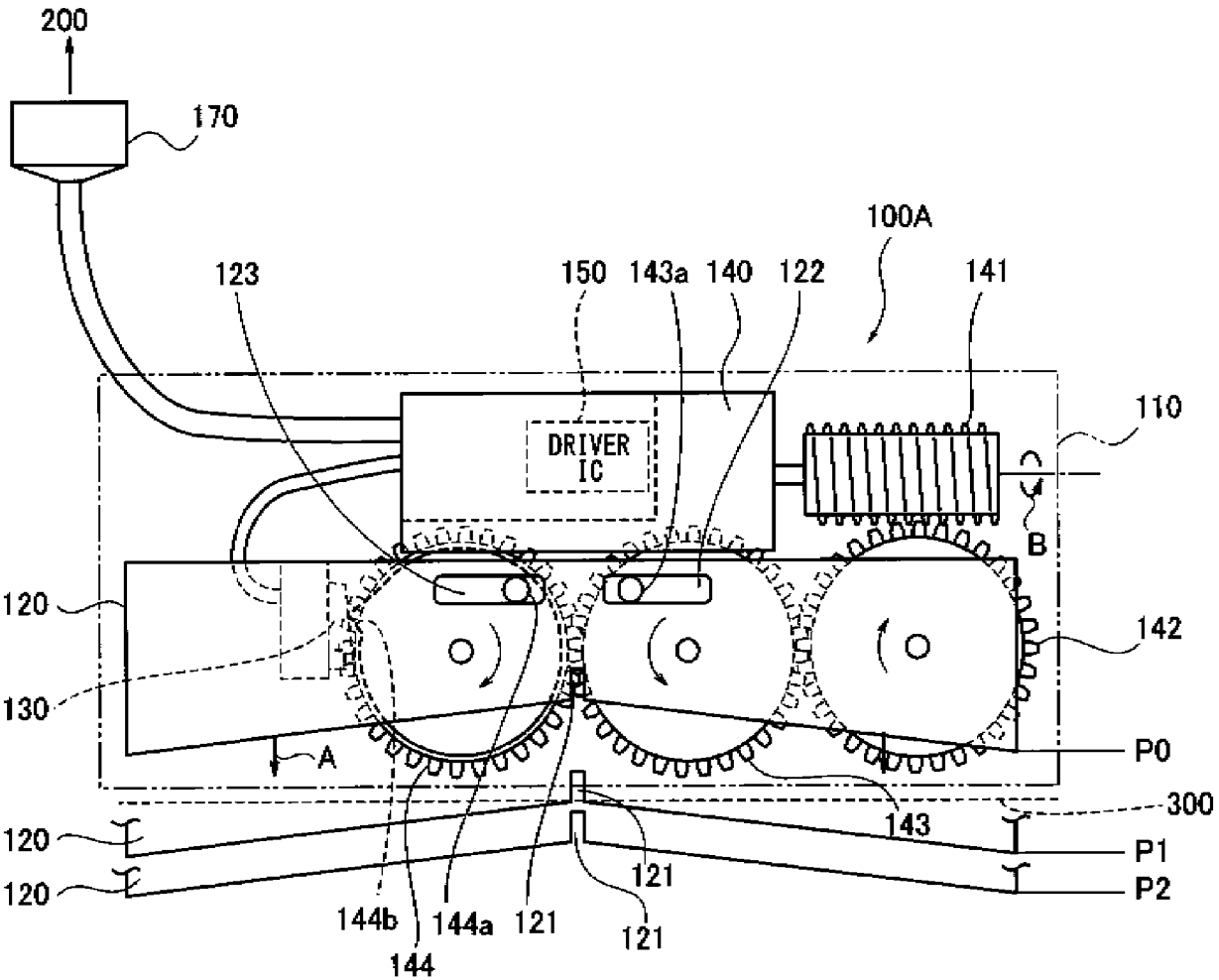
FIG. 4 shows an example of another cutter unit according to a second embodiment of the present invention.

Next, a cutter unit 100A according to a second embodiment is described with reference to FIG. 4. A difference between the cutter unit 100A and the cutter unit 100 in the first embodiment is in that the motor 140 accommodates only one of the driver IC 150 and the control IC 160 and the other is disposed in a different space in the cutter unit 100A. FIG. 4 shows the motor 140 containing the driver IC 150 alone by way of example.

Along with an increasing demand for downsizing the printer, the cutter unit is also required to be downsized. A small type motor may be used for the purpose of downsizing the cutter unit.

The cutter unit 100A includes such a small type motor 140A. If there is no sufficient space in the small type motor 140 to accommodate both the driver IC 150 and the control IC 160, the motor 140 is configured to accommodate only either of them and the other is placed in a different space inside the cutter unit 100A.

Further, the motor 140 can be of various types such as stepping motor, DC motor. It is therefore possible to select a driver IC 150 suitable for a specific type of motor and accommodate that in the motor 140 and dispose the control IC 160 (not shown) in a different space inside the cutter unit 100A. This makes it possible to deal with a change in the specification of the cutter unit such as paper cutting performance or durability by only replacing the motor. Accordingly, the degree of freedom where the cutter unit is designed can be improved.

In the above embodiments, the cutter unit of a guillotine type has been described by way of example. However, the present invention should not be limited to such an example. It is also applicable to an iron type or pizza cutter type cutter unit.

Further, the cutter unit according to one of the above embodiments includes the control IC 160 to control the basic operation of the cutter unit independently. Therefore, upon receiving a cutting instruction from the controller of the printer, the control IC 160 can control the operation of the individual elements of the cutter unit, so that the printer 200 has only to provide the full-cut or partial cut instruction to the cutter unit 100.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A cutter unit to be incorporated into a printer to cut a paper in accordance with an instruction from a controller of the printer, said cutter unit comprising:
- a movable cutter blade;
- a position indicating element for representing a position of said cutter blade;
- a position sensor for detecting a position of said position indicating element so as to determine whether said cutter blade is or is not in a reference position, and for outputting a position signal based on the detected position of said position indicating element;
- a motor for moving said cutter blade;
- a drive circuit for driving said motor; and
- a cutter control element configured to control said drive circuit to:
  - drive said cutter blade to perform a partial cut of the paper when a partial cut instruction has been received from the controller of the printer and said position sensor outputs a position signal indicating that said cutter blade is in the reference position; and
  - drive said cutter blade to perform a full cut of the paper when a full cut instruction has been received from the controller of the printer and said position sensor outputs a position signal indicating that said cutter blade is in the reference position.

2. The cutter unit of claim 1, wherein said cutter control element is configured to control the drive circuit to:
- drive said motor to set the cutter blade at the reference position upon receiving the cut instruction from the controller of the printer; and
- drive said motor an amount to return said cutter blade to the reference position after completing a cutting operation based on the cut instruction received from the controller of the printer.

3. The cutter unit of claim 2, wherein said cutter control element is further configured to control the drive circuit to:
- drive said motor a first amount so that the paper is partially cut by said cutter blade with a part of the paper remaining uncut when a partial cut instruction is received from the controller of the printer; and
- drive said motor a second amount so that the paper is completely cut by said cutter blade when a full cut instruction is received from the controller of the printer.

4. The cutter unit of claim 1, wherein said motor accommodates at least one of said drive circuit and said cutter control element.

5. The cutter unit of claim 1, further comprising a set of worm wheels engaged with said cutter blade, said set of worm wheels being driven by said motor so as to move said cutter blade.

6. The cutter unit of claim 5, wherein said position indicating element comprises a claw located on one of said worm wheels.

7. The cutter unit of claim 6, wherein said position sensor includes a switch to be triggered by said claw.

8. The cutter unit of claim 7, wherein said switch is a mechanical switch configured to be triggered by mechanical contact with said claw.

9. The cutter unit of claim 7, wherein said switch is an optical switch configured to be triggered when said claw blocks light to said optical switch.

10. The cutter unit of claim 1, wherein said position indicating element includes a claw configured to be positioned in direct correspondence to a position of said cutter blade, and said position sensor includes a stationary switch to be triggered by said claw when said cutter blade is in a particular position.

11. The cutter unit of claim 10, wherein said switch is a mechanical switch configured to be triggered by mechanical contact with said claw.

12. The cutter unit of claim 10, wherein said switch is an optical switch configured to be triggered when said claw blocks light to said optical switch.

* * * * *